US007296543B2

(12) United States Patent
Namuduri et al.

(10) Patent No.: US 7,296,543 B2
(45) Date of Patent: Nov. 20, 2007

(54) ENGINE COOLANT PUMP DRIVE SYSTEM AND APPARATUS FOR A VEHICLE

(75) Inventors: Chandra S. Namuduri, Troy, MI (US); David S. Rule, Waterford, MI (US); Balarama V. Murty, West Bloomfield, MI (US)

(73) Assignee: GM Global Technology Operations, Inc., Detroit, MI (US)

( * ) Notice: Subject to any disclaimer, the term of this patent is extended or adjusted under 35 U.S.C. 154(b) by 0 days.

(21) Appl. No.: 11/399,669

(22) Filed: Apr. 6, 2006

(65) Prior Publication Data

US 2007/0234980 A1 Oct. 11, 2007

(51) Int. Cl.
*F01P 5/10* (2006.01)

(52) U.S. Cl. ..... 123/41.44; 123/41.47

(58) Field of Classification Search ..... 123/41.44, 123/41.47

See application file for complete search history.

(56) References Cited

U.S. PATENT DOCUMENTS 5,619,957 A * 4/1997 Michels ..... 123/41.44
6,318,531 B1 11/2001 Usoro ..... 192/21.5
6,561,141 B2 * 5/2003 Stretch et al. ..... 123/41.44
6,612,815 B2 9/2003 Pawellek ..... 417/366
6,668,766 B1 12/2003 Liederman et al. ..... 123/41.44
2004/0194459 A1 10/2004 Namuduri ..... 60/435

* cited by examiner

*Primary Examiner*—Noah P. Kamen

(57) ABSTRACT

An engine coolant pump drive system for a vehicle having an engine, an engine coolant system, and at least one sensor for sensing at least one operational condition of the vehicle is disclosed. The pump drive system includes a magnetorheological fluid (MRF) clutch, and a coolant pump. The MRF clutch includes a torque input section coupled to a torque output section via a MRF, the torque input section being configured to receive a torque input from the engine. The coolant pump is configured for operable communication with the torque output section of the MRF clutch. In response to a signal from the at least one sensor, the MRF clutch is configured to provide a continuously variable torque transfer from the torque input section to the torque output section, thereby providing for variable coolant flow in the engine coolant system via the coolant pump capable of a continuously variable speed.

16 Claims, 3 Drawing Sheets

ENGINE COOLANT PUMP DRIVE SYSTEM AND APPARATUS FOR A VEHICLE

BACKGROUND OF THE INVENTION

The present disclosure relates generally to an engine coolant pump drive system and apparatus, and particularly to a variable speed engine coolant pump drive system and apparatus.

A typical engine cooling system employs an engine driven water pump, driven by a belt for example, for circulating coolant fluid, such as a water-glycol mixture for example, that is circulated through the engine block and the radiator. Since the pump is driven directly by the engine using a belt, its speed is determined by that of the engine, and it operates continuously as long as the engine is running, resulting in continuous losses due to constant operation and constant circulation of the coolant fluid through the cooling loop, whether the cooling action is needed or not. Also, the pump has to be designed to provide the required flow and pressure for the worst-case engine speed, which could be near idle or during high grade towing. This results in much higher pump flow at higher engine speeds than is necessary, further increasing the losses in the coolant system, which results ultimately in increased fuel consumption.

Other water pump systems have been introduced to decouple the coolant pump from the engine and provide an on-demand coolant flow using an electric motor-driven or electrically operated clutch driven pump. Both of these systems offer improvement to the vehicle fuel economy by providing an on-demand coolant flow and minimizing and/or eliminating the parasitic losses associated with the engine belt-driven coolant pump. However, the electric motor-driven coolant pump needs a high power electric motor, power electronics for controlling the speed of the motor, and a reliable electrical power supply, which includes the engine driven alternator and the battery. The overall power losses in a typical electric motor-driven coolant pump still involves significant losses through the engine alternator, power electronics, electric motor, and pump system. An electrically operated clutch driven coolant pump, employing an electromagnetic clutch for example, may be either on or off, with no continuous adjustment of the output speed being possible, resulting in significant shock loads on the engine.

Accordingly, there is a need in the art for an engine coolant pump drive system that overcomes these drawbacks.

BRIEF DESCRIPTION OF THE INVENTION

An embodiment of the invention includes an engine coolant pump drive system for a vehicle having an engine, an engine coolant system, and at least one sensor for sensing at least one operational condition of the vehicle. The pump drive system includes a magnetorheological fluid (MRF) clutch, and a coolant pump. The MRF clutch includes a torque input section coupled to a torque output section via a MRF, the torque input section being configured to receive a torque input from the engine. The coolant pump is configured for operable communication with the torque output section of the MRF clutch. In response to a signal from the at least one sensor, the MRF clutch is configured to provide a continuously variable torque transfer from the torque input section to the torque output section, thereby providing for variable coolant flow in the engine coolant system via the coolant pump capable of a continuously variable speed.

Another embodiment of the invention includes a magnetorheological fluid (MRF) clutch for coupling an engine coolant pump with an engine of a vehicle having at least one sensor productive of a signal representative of a temperature of the engine. The MRF clutch includes a torque input section coupled to a torque output section via a MRF, the torque input section being configured to receive a torque input from the engine. The torque input section includes first and second portions with a space therebetween, the first portion being radially outboard of the second portion, the first portion being configured to receive a torque input from the engine, the first and second portions being configured to rotate together about the same axis of rotation. The torque output section includes a rotor attached to a shaft, the rotor being disposed within the space between the first and second portions so as to form an annulus between the rotor and the first and second portions, the annulus containing a MRF, and the shaft being configured for operable communication with the coolant pump. The MRF clutch also includes a stationary magnetic field generator disposed radially inboard of the second portion. In response to a signal from the at least one sensor, the magnetic field generator is capable of generating a variable strength magnetic field that is in field communication with the first portion, the second portion, the rotor, and the MRF, thereby providing for a continuously variable torque transfer from the torque input section to the torque output section.

BRIEF DESCRIPTION OF THE DRAWINGS

Referring to the exemplary drawings wherein like elements are numbered alike in the accompanying Figures.

DETAILED DESCRIPTION OF THE INVENTION

An embodiment of the invention provides a means to directly control the speed of an engine driven coolant pump by using a magnetorheological fluid (MRF) coupling (clutch) integrated between an accessory drive of the engine and the engine coolant pump. The MRF clutch provides for a continuously adjustable pump speed by controlling the torque transmitted from the engine drive shaft to that of the engine coolant pump. The MRF clutch may be part of the pump assembly or part of a pulley assembly.

An electronic controller is used to interface engine sensors (engine rpm, throttle angle, manifold absolute pressure, coolant temperature, engine cylinder head temperature, for example) and vehicle sensors (speed, accelerator pedal position, brake pedal position, for example) with an electronic amplifier to generate a current signal to an excitation coil embedded in the MRF clutch, thereby enabling the speed of the pump to vary in a continuous manner. It is also envisioned that an integrated speed sensor within the pump and/or a pressure or flow sensor in the coolant lines may be used to provide additional control information to the electronic controller for adjusting the MRF clutch coil current.

An embodiment of the invention provides an engine coolant pump drive system having the MRF clutch integrally arranged with the coolant pump. Another embodiment provides the MRF clutch external to the coolant pump. Both pump drive systems are configured for efficiently cooling the engine of a vehicle by providing for variable coolant flow via the coolant pump, which may be operated by continuously varying its speed according to the operating conditions of the vehicle. As such, an embodiment of the invention may be employed for the purpose of minimizing parasitic power losses present in a belt driven engine coolant pump by providing a variable speed direct drive or pulley drive.

Figure 1:
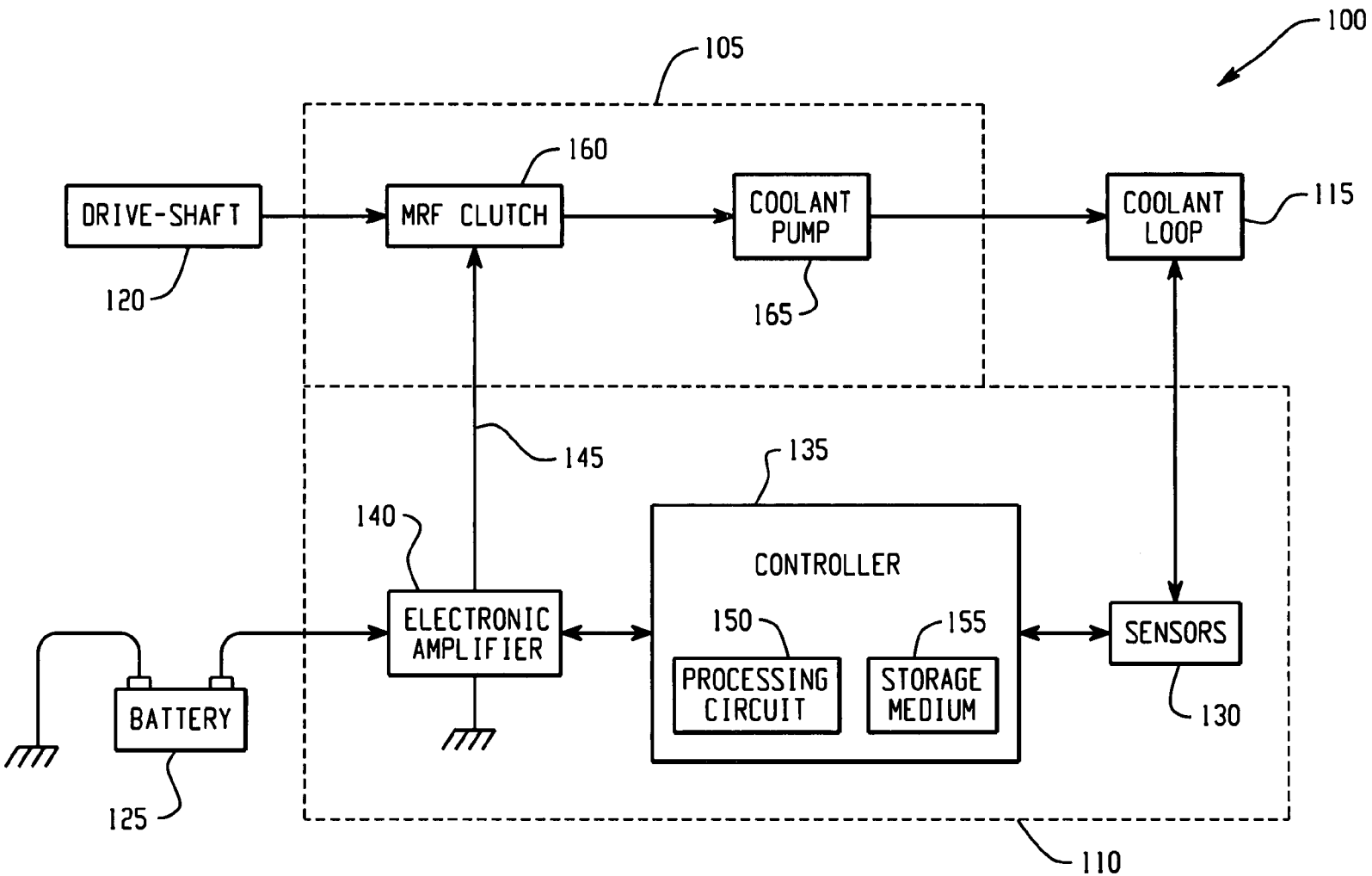
FIG. 1 depicts in block diagram form an exemplary embodiment of an engine coolant system in accordance with an embodiment of the invention.

FIG. 1 depicts in block diagram form an exemplary embodiment of an engine coolant system 100 having an engine coolant pump drive system 105, a control system 110 responsive to one or more vehicle operating conditions and productive of a control signal to pump drive system 105, a coolant loop 115, such as a radiator and engine block with cooling channels (not specifically shown but known in the art), responsive to an output torque or speed from pump drive system 105, an engine auxiliary drive shaft 120 for providing an input torque to pump drive system 105, and a power source 125 for providing electrical power to control system 110. Auxiliary drive shaft 120 is arranged in operable communication with the vehicle engine by any means suitable for providing an input torque to pump drive system 105 for the purposes disclosed herein.

In an embodiment, the control system 110 includes a set of sensors 130 disposed to receive signals representative of various operating conditions of the vehicle, a controller 135 in signal communication with the sensors 130, and an electronic amplifier 140 in signal communication with the controller 135 and productive of a control signal 145 directed to the pump drive system 105. The electronic amplifier may be of a Pulse Width Modulating (PWM) type, or a linear type, and are known in the art. Communication between sensors 130, controller 135, and electronic amplifier 140, may be by a communication bus or a CAN (controller area network) communication link (represented generally by the arrowhead lines in FIG. 1 between the respective devices). In an embodiment, the set of sensors 130 may include one or more of the following, in any combination: a temperature sensor productive of a signal representative of the temperature of the engine, an engine revolutions-per-minute (rpm) sensor, a vehicle throttle angle sensor, a vehicle MAP (manifold absolute pressure) sensor, an engine coolant system temperature sensor, an engine cylinder head temperature sensor, a vehicle speed sensor, a vehicle acceleration sensor, a vehicle acceleration pedal position sensor, a vehicle brake pedal position sensor, a coolant pump speed sensor, a coolant pump fluid pressure sensor, and a coolant pump fluid flow sensor. While a defined set of sensors have been herein described, it will be appreciated that the scope of the invention is not so limited, and that other sensors or switches may also be employed, such as an ambient temperature sensor, a heater control switch, or an air conditioner control switch, for example. In an embodiment, the controller 135 includes a processing circuit 150 and a storage medium 155, readable by the processing circuit 150, storing instructions for execution by the processing circuit 150 for receiving a signal from the set of sensors 130, and for providing a signal to the electronic amplifier 140 for providing the control signal 145.

In an embodiment, the pump drive system 105 includes a MRF clutch 160 in operable communication with a coolant pump 165, which may be integrally arranged with the MRF clutch 160 as will be described in more detail below.

Figure 2:
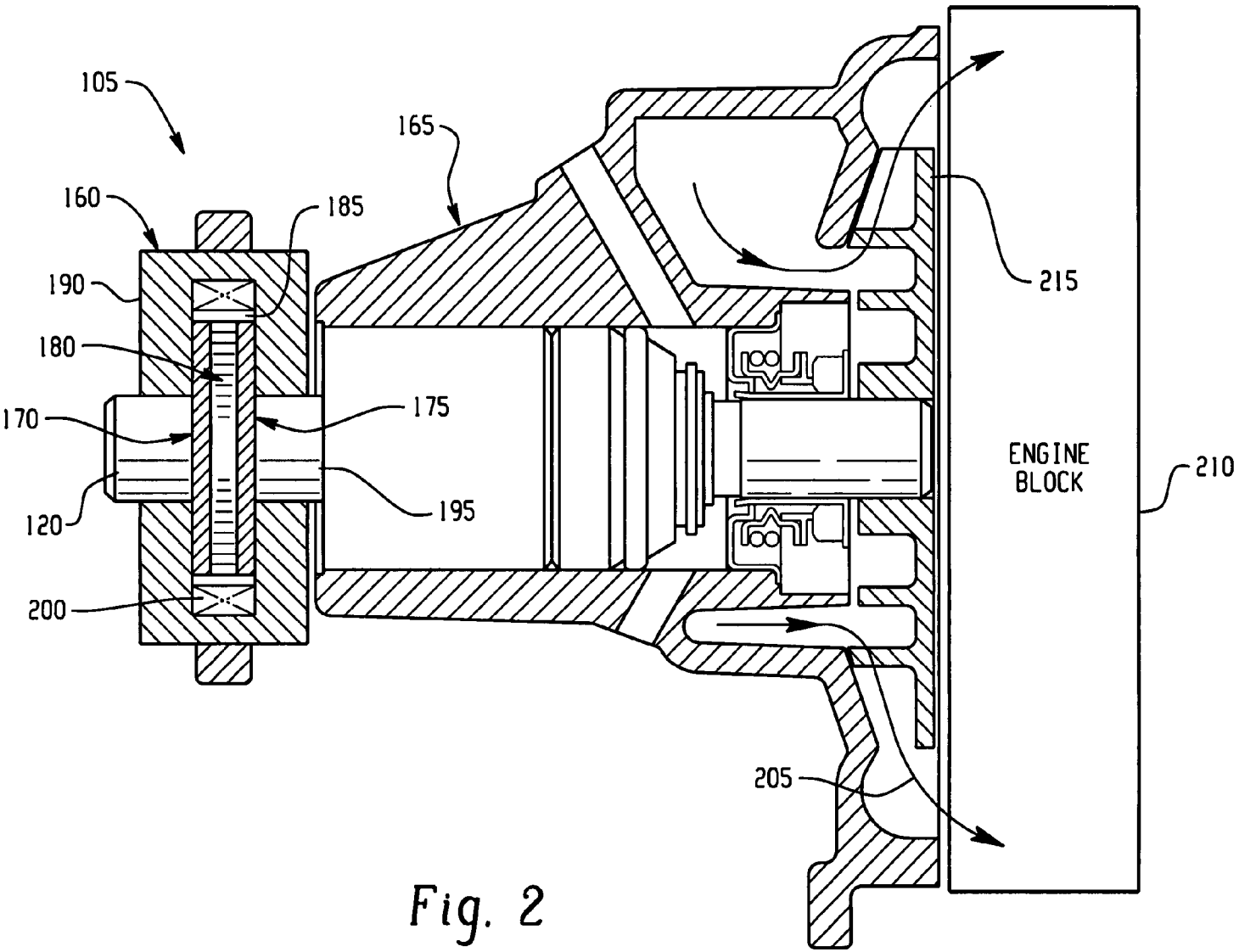
FIG. 2 depicts in cross-sectional view an exemplary embodiment of a pump drive system in accordance with an embodiment of the invention.

Referring now to FIG. 2, an exemplary embodiment of pump drive system 105 is depicted in cross-section view having MRF clutch 160 coupled to coolant pump 165, which may be of a type known in the art, in a hub arrangement between the coolant pump 165 and the auxiliary drive shaft 120. A pulley wheel arrangement will be discussed below with reference to FIG. 3.

In an embodiment, and with reference still to FIG. 2, the MRF clutch 160 includes a torque input section 170 coupled to a torque output section 175 via a MRF 180, the torque input section 170 being configured to receive a torque input from the engine, such as via auxiliary drive shaft 120 for example. Torque input section 170 is disposed within a cavity 185 of a housing 190, is generally circular in shape, is made of a ferrous material, and is fixed to the drive-shaft 120 by any suitable means. The torque output section 175 is also disposed within the cavity 185, is also generally circular in shape, is made of ferrous material, and is fixed to an intermediate shaft 195 by any suitable means. The intermediate shaft 195 is operably connected to the coolant pump 165 by known means. MRF clutch 160 also includes an excitation coil 200 disposed within the cavity 185 and about the torque input section 170 and the torque output section 175. The coil 200 is spaced a predetermined distance from the torque input section 170 and the torque output section 175, and is connected by suitable means such as wires to the electronic amplifier 140. Disposed within the cavity 185 is the MRF 180 between the torque input section 170 and the torque output section 175. In an embodiment, MRF 180 contains magnetizable particles such as carbonyl iron spheroids of about one to fifty microns in diameter dispersed in a viscous fluid such as synthetic hydrocarbon oil that has a viscosity between about 10 and 10,000 cP (centi-Poise). However, it will be appreciated that MRF 180 may be of a type known in the art and may also contain surfactants, flow modifiers, lubricants, viscosity enhancers, and/or other additives.

In response to a signal from the set of sensors 130, electronic amplifier 140 provides a control signal 145 to MRF clutch 160, which energizes coil 200 in such a manner as to provide a magnetic field across torque input section 170, MRF 180, and torque output section 175, thereby activating the MRF 180 to provide a torque transfer from the torque input section 170 to the torque output section 175. In response to a continuously variable control signal 145, a continuously variable torque transfer from the torque input section 170 to the torque output section 175 may be provided, thereby providing for variable coolant flow 205 directed to the engine block 210 via an impeller 215 in coolant pump 165, which operates under a continuously variable speed.

Figure 3:
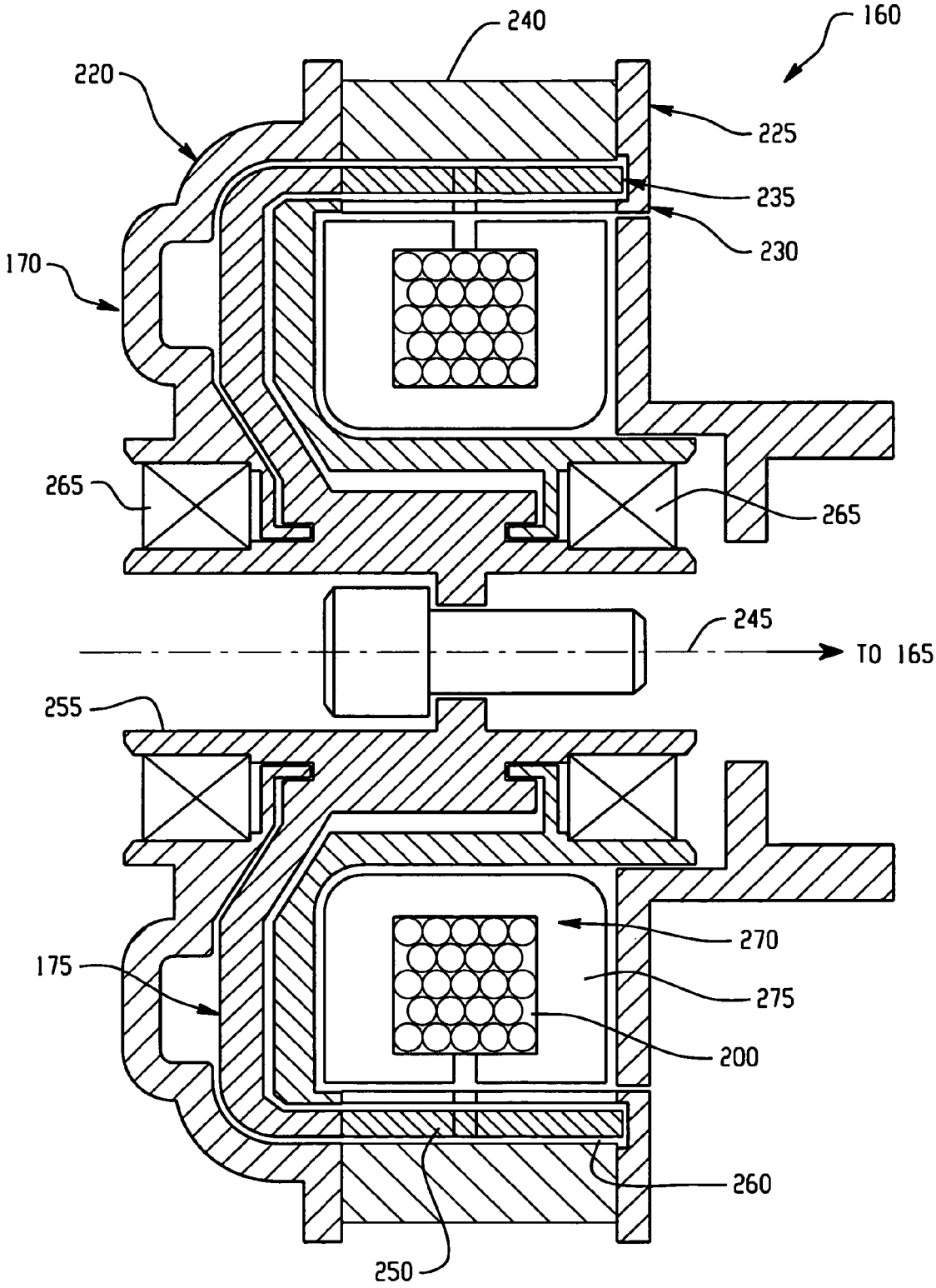
FIG. 3 depicts in cross-sectional view an exemplary embodiment of a magnetorheological clutch for use in an exemplary pump drive system in accordance with an embodiment of the invention.

Referring now to FIG. 3, an exemplary embodiment of MRF clutch 160 for use in pump drive system 105 is depicted in cross-section view, where MRF clutch 160 is coupled to coolant pump 165. In FIG. 3, coolant pump 165 is not specifically illustrated, but may be of a type similar to that illustrated in FIG. 2. Here, the torque input section 170 includes a pulley wheel 220 having first 225 and second 230 portions with a space 235 therebetween. The first portion 225 is radially outboard of the second portion 230. The first portion 225 is configured to receive a torque input from the engine, such as via a drive belt (not shown but known in the art) cooperating with a radial surface 240 of pulley wheel 220. The first and second portions 225, 230 are configured to rotate together about the same axis of rotation 245. The torque output section 175 includes a rotor 250 attached to a shaft 255. The rotor 250 is disposed within the space 235 between the first 225 and second 230 portions of the pulley wheel 220 so as to form an annulus 260 between the rotor 250 and the first and second portions 225, 230. The annulus 260 is sized to contain a MRF (not specifically illustrated in FIG. 3, but similar to the MRF 180 discussed previously with reference to FIG. 2). The shaft 255 is configured for operable communication with the coolant pump 165 by any suitable means, such as a keyed axle arrangement for example. The rotor 250 and shaft 255 are configured to rotate together about axis 245. The torque input and torque output sections 170, 175 cooperate with each other via bearings 265.

MRF clutch 160 also includes a magnetic field generator 270, having coil 200 and a stator 275, disposed radially inboard of the second portion 230 of the pulley wheel 220. Similar to the previous discussion relating to FIG. 2, in response to a signal from the set of sensors 130 and a control signal 145 from electronic amplifier 140, the coil 200 of magnetic field generator 270 is capable of generating a variable strength magnetic field that is in field communication with the stator 275, the first portion 225, the second portion 230, the rotor 250, and the MRF 180 in annulus 260, thereby providing for a continuously variable torque transfer from the torque input section 170 to the torque output section 175.

In general, the set of sensors 130 are configured to provide a variable signal representative of a variable temperature of the engine, and the MRF clutch 160 is responsive to a non-zero variable control signal 145 arising from at least one of the set of sensors 130, thereby providing continuously variable speed control to the coolant pump 165.

In an embodiment, stator 275, first portion 225, second portion 230, and rotor 250, are constructed using magnetic and non-magnetic materials that serve to direct the magnetic field created by coil 200 in such a manner as to efficiently excite MRF 180 in annulus 260, thereby resulting in efficient torque transfer to coolant pump 165.

During cold engine operation, such as at start up or where the ambient temperature is extremely low, an embodiment of the invention may generate only a small control signal 145 to coil 200, thereby resulting in low torque transfer from torque input section 170 to torque output section 175, and a slow operational speed of pump 165, thereby allowing the engine to get up to temperature quickly. During warm engine operation, such as when the engine is at a desired operating temperature, an embodiment of the invention may generate a large control signal 145 to coil 200, thereby resulting in high torque transfer from torque input section 170 to torque output section 175, and a fast operational speed of pump 165, thereby allowing the high coolant flow through a radiator to maintain the desired engine operating temperature. During periods of high vehicle speed, such as on a highway for example, where increased air flow across the vehicle radiator would typically provide for a greater heat transfer of engine heat to ambient, an embodiment of the invention may generate only a moderate control signal 145 to coil 200, thereby resulting in moderate torque transfer from torque input section 170 to torque output section 175, and a moderate operational speed of pump 165, thereby allowing for both effective and efficient cooling of the engine. As can be seen, strategically placed sensors 130 that sense a variety of vehicle operating characteristics, in combination with an appropriate algorithm in controller 135, may be employed to generate a variety of characteristics for control signal 145, depending on the cooling needs of a particular engine.

While certain combinations of sensors 130 have been described herein, it will be appreciated that these certain combinations are for illustration purposes only and that any combination of any of sensors 130 may be employed in accordance with an embodiment of the invention. Any and all such combinations are contemplated herein and are considered within the scope of the invention disclosed.

An embodiment of the invention may be embodied in the form of computer-implemented processes and apparatuses for practicing those processes. The present invention may also be embodied in the form of a computer program product having computer program code containing instructions embodied in tangible media, such as floppy diskettes, CD-ROMs, hard drives, USB (universal serial bus) drives, random access memory (RAM), read only memory (ROM), erasable programmable read only memory (EPROM), or any other computer readable storage medium, wherein, when the computer program code is loaded into and executed by a computer, the computer becomes an apparatus for practicing the invention. The present invention may also be embodied in the form of computer program code, for example, whether stored in a storage medium, loaded into and/or executed by a computer, or transmitted over some transmission medium, such as over electrical wiring or cabling, through fiber optics, or via electromagnetic radiation, wherein when the computer program code is loaded into and executed by a computer, the computer becomes an apparatus for practicing the invention. When implemented on a general-purpose microprocessor, the computer program code segments configure the microprocessor to create specific logic circuits. A technical effect of the executable instructions is to variably control the speed of an engine coolant pump.

As disclosed, some embodiments of the invention may include some of the following advantages: improved fuel economy due to elimination of losses due to double energy conversion present in an electrically driven pump; less packaging issues with the MRF clutch integrated into the engine coolant pump pulley; reduced cost due to a simple low current controller replacing a costly high-current power electronics of an electric drive system; variable coolant flow by controlling the pump speed allowing faster engine warm-up and potentially reduced emissions; reduced mass due to elimination of electric motor and high-current power electronics of an electric drive system; and, improved reliability due to reduced number of components.

While the invention has been described with reference to exemplary embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best or only mode contemplated for carrying out this invention, but that the invention will include all embodiments falling within the scope of the appended claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited. Moreover, the use of the terms first, second, etc. do not denote any order or importance, but rather the terms first, second, etc. are used to distinguish one element from another. Furthermore, the use of the terms a, an, etc. do not denote a limitation of quantity, but rather denote the presence of at least one of the referenced item.

What is claimed is:

1. An engine coolant pump drive system for a vehicle having an engine, an engine coolant system, and at least one sensor for sensing at least one operational condition of the vehicle, the pump drive system comprising:

a magnetorheological fluid (MRF) clutch comprising a torque input section coupled to a torque output section via a MRF, the torque input section configured to receive a torque input from the engine; and a coolant pump configured for operable communication with the torque output section of the MRF clutch;

wherein the torque input section comprises first and second portions with a space therebetween, the first portion being radially outboard of the second portion, the first portion configured to receive a torque input from the engine, the first and second portions configured to rotate together about the same axis of rotation;

wherein the torque output section comprises a rotor attached to a shaft, the rotor disposed within the space between the first and second portions so as to form an annulus between the rotor and the first and second portions, the annulus containing a MRF, the shaft configured for operable communication with the coolant pump; and wherein in response to a signal from the at least one sensor, the MRF clutch is configured to provide a continuously variable torque transfer from the torque input section to the torque output section, thereby providing for variable coolant flow in the engine coolant system via the coolant pump capable of a continuously variable speed.

2. The pump drive system of claim 1, wherein:

the torque input section comprises a pulley wheel comprising first and second portions with a space therebetween, the first portion being radially outboard of the second portion, the first portion configured to receive a torque input from the engine, the first and second portions configured to rotate together about the same axis of rotation; and the torque output section comprises a rotor attached to a shaft, the rotor disposed within the space between the first and second portions of the pulley wheel so as to form an annulus between the rotor and the first and second portions, the annulus containing a MRF, the shaft configured for operable communication with the coolant pump.

3. The pump drive system of claim 2, further comprising:

a magnetic field generator disposed radially inboard of the second portion of the pulley wheel;

wherein in response to a signal from the at least one sensor, the magnetic field generator is capable of generating a variable strength magnetic field that is in field communication with the first portion, the second portion, the rotor, and the MRF, thereby providing for a continuously variable torque transfer from the torque input section to the torque output section.

4. The pump drive system of claim 2, wherein:

the pulley wheel is configured to be driven by a belt in operable communication with the engine.

5. The pump drive system of claim 1, further comprising:

a magnetic field generator disposed radially inboard of the second portion;

wherein in response to a signal from the at least one sensor, the magnetic field generator is capable of generating a variable strength magnetic field that is in field communication with the first portion, the second portion, the rotor, and the MRF, thereby providing for a continuously variable torque transfer from the torque input section to the torque output section.

6. The pump drive system of claim 5, wherein:

the magnetic field generator comprises a stator and a coil, the coil configured to be responsive to a control signal arising from the at least one sensor, and to be productive of the variable strength magnetic field, which is in field communication with the stator.

7. The pump drive system of claim 1, wherein the control system comprises:

the at least one sensor;

a controller in signal communication with the at least one sensor; and an electronic amplifier in signal communication with the controller, the electronic amplifier configured to provide the control signal.

8. The pump drive system of claim 7, wherein the controller comprises:

a processing circuit; and a storage medium, readable by the processing circuit, storing instructions for execution by the processing circuit for:

receiving a signal from the at least one sensor; and providing a signal to the electronic amplifier for providing the control signal.

9. The pump drive system of claim 1, wherein the at least one sensor comprises:

a temperature sensor productive of a signal representative of the temperature of the engine.

10. The pump drive system of claim 1, wherein the at least one sensor comprises:

an engine revolutions-per-minute sensor, a vehicle throttle angle sensor, a vehicle manifold absolute pressure (MAP) sensor, an engine coolant system temperature sensor, an engine cylinder head temperature sensor, a vehicle speed sensor, a vehicle acceleration sensor, a vehicle acceleration pedal position sensor, a vehicle brake pedal position sensor, a coolant pump speed sensor, a coolant pump fluid pressure sensor, a coolant pump fluid flow sensor, or any combination comprising at least one of the foregoing sensors.

11. The pump drive system of claim 1, wherein:

the at least one sensor is configured to provide a variable signal representative of a variable temperature of the engine; and the MRF clutch is responsive to a non-zero variable control signal from the control system thereby providing continuously variable speed control to the coolant pump.

12. The pump drive system of claim 1, further comprising:

a control system responsive to the at least one operational condition of the vehicle, and productive of a control signal to the MRF clutch for providing the continuously variable torque transfer from the torque input section to the torque output section.

13. The pump drive system of claim 1, further comprising:

a control system responsive to a signal from the at least one sensor, and productive of at least a first control signal, a second control signal, and a third control signal, to the MRF clutch, the first control signal being productive of a first level of torque transfer across the MRF clutch, the second control signal being productive of a second level of torque transfer across the MRF clutch greater than the first level of torque transfer, and the third control signal being productive of a third level of torque transfer across the MRF clutch greater than the second level of torque transfer.

14. A magnetorheological fluid (MRF) clutch for coupling an engine coolant pump with an engine of a vehicle having at least one sensor productive of a signal representative of a temperature of the engine, the MRF clutch comprising:

a torque input section coupled to a torque output section via a MRF, the torque input section configured to receive a torque input from the engine;

the torque input section comprising first and second portions with a space therebetween, the first portion being radially outboard of the second portion, the first portion configured to receive a torque input from the engine, the first and second portions configured to rotate together about the same axis of rotation;

the torque output section comprising a rotor attached to a shaft, the rotor disposed within the space between the first and second portions so as to form an annulus between the rotor and the first and second portions, the annulus containing a MRF, the shaft configured for operable communication with the coolant pump; and a stationary magnetic field generator disposed radially inboard of the second portion;

wherein in response to a signal from the at least one sensor, the magnetic field generator is capable of generating a variable strength magnetic field that is in field communication with the first portion, the second portion, the rotor, and the MRF, thereby providing for a continuously variable torque transfer from the torque input section to the torque output section.

15. The MRF clutch of claim 14, wherein:

the torque input section comprises a pulley wheel comprising the first and second portions, the pulley wheel being configured to be driven by a belt in operable communication with the engine.

16. The MRF clutch of claim 14, wherein the vehicle further comprises a control system responsive to a signal from the at least one sensor, and productive of at least a first control signal, a second control signal, and a third control signal, to the MRF clutch, wherein:

in response to the first control signal, a first level of torque transfer from the torque input section to the torque output section results;

in response to the second control signal, a second level of torque transfer from the torque input section to the torque output section results;

in response to the third control signal, a third level of torque transfer from the torque input section to the torque output section results; and the second level of torque transfer is greater than the first level of torque transfer, and the third lever of torque transfer is greater than the second level of torque transfer.

* * * * *